US005489100A

United States Patent [19]

Potter

[11] Patent Number: 5,489,100

[45] Date of Patent: Feb. 6, 1996

[54] TRAINING GOLF CLUBS

[76] Inventor: George A. J. Potter, 32 Wensleydale Drive, Heatherside, Camberley, Surrey GU15, United Kingdom

[21] Appl. No.: 313,150

[22] PCT Filed: Jul. 13, 1992

[86] PCT No.: PCT/GB92/01268

§ 371 Date: Nov. 22, 1994

§ 102(e) Date: Nov. 22, 1994

[87] PCT Pub. No.: WO93/19820

PCT Pub. Date: Oct. 14, 1993

[30] Foreign Application Priority Data

Apr. 2, 1992 [GB] United Kingdom ..... 9207729

[51] Int. Cl.[6] ..... A63B 69/36

[52] U.S. Cl. ..... 273/186.2; 273/193 B; 403/104; 403/107

[58] Field of Search ..... 273/193 B, 193 A, 273/194 R, 193 R, 186.2, 80 B, 80 C, 80 D, 80.1, 186.1, 81.2, 81.3; 403/107, 106, 104, 103

[56] References Cited

U.S. PATENT DOCUMENTS

| | | | |
|---|---|---|---|
| 1,529,305 | 6/1924 | Gatke . | |
| 2,497,237 | 3/1948 | Reineking . | |
| 3,679,205 | 7/1972 | Finkle et al. . | |
| 4,856,782 | 8/1989 | Cannan . | |
| 5,195,748 | 3/1993 | Koch et al. | 273/193 B |
| 5,255,994 | 10/1993 | Stein | 273/186.2 |
| 5,277,427 | 1/1994 | Bryan et al. | 273/186.2 |
| 5,358,352 | 10/1994 | Klarhorst | 403/104 |

*Primary Examiner*—Vincent Millin
*Assistant Examiner*—Steven B. Wong
*Attorney, Agent, or Firm*—Lowe, Price, LeBlanc & Becker

[57] ABSTRACT

A training golf club with a spring-loaded hinge between two club half-shafts which "breaks" if the club swing is skewed or jerky is disclosed. First and second main hinge components lie side by side with a pivot shaft passing through them and with offset shanks for attachment to the club half-shafts. Springs and balls are located in bores in the first main hinge component, the balls engaging in depressions in a circular track on the second main hinge component when the two shanks are aligned. The other ends of the springs bear, via balls, against an adjustment ring. On rotation of this ring, the balls engage in one of a plurality of sets of depressions of different depths in the ring, so adjusting the "break" force of the hinge.

16 Claims, 3 Drawing Sheets

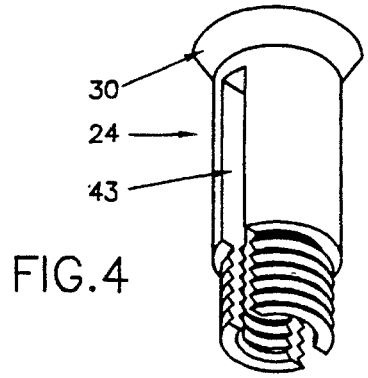
FIG.4
FIG.2
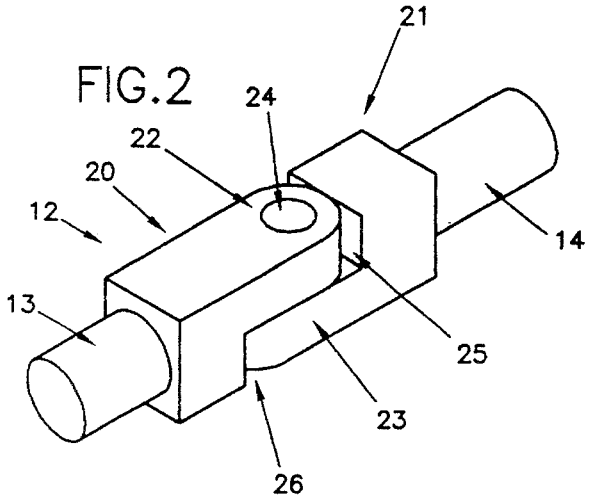
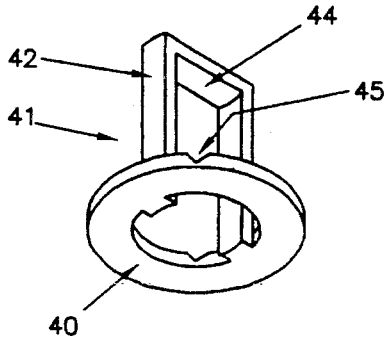
FIG.3
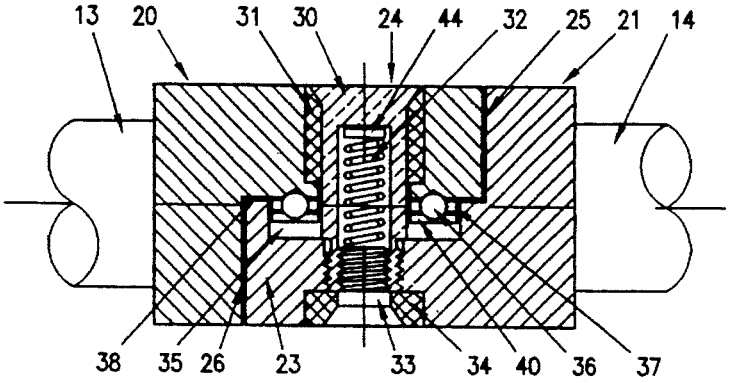

TRAINING GOLF CLUBS

The present invention relates to golf clubs, and more specifically to training clubs designed to assist in the training and practicing of golfers.

Achieving a good "swing" with a golf club, and in particular a driver, requires great skill, and perfecting a swing requires much practice. One major requirement is that the action should be smooth and free of jerks. To assist golfers in achieving this, training clubs have been proposed in which the shaft is not rigid, so that the shaft bends during a swing which is jerky.

More particularly, training clubs have been proposed in which the shaft incorporates a spring-loaded joint or hinge, so that for a swing within acceptable limits of smoothness the shaft remains straight, but for a swing which exceeds those limits, the shaft "breaks" at the joint. The club is generally constructed as a pair of half-shafts attached to a self-contained hinge structure. (The term "half-shaft" is used for convenience, but the location of the hinge is preferably closer to the head than the handle of the shaft.)

At least two specific designs for such clubs have been proposed, in U.S. Pat. Nos. 2,497,237 (Reineking) and 4,854,585 (Koch and Koch). In both these designs, the hinge is of a fork type, with one half-shaft having a pair of arms forming a fork and the other half-shaft having a single arm which is received within the fork, and a pivot shaft passing transversely through all three arms. The single arm terminates in a generally circular arc with a depression in it, and the other half-shaft has an axial bore containing a spring-loaded detent element which bears against the circular arc and engages in the depression in that arc.

In this type of design, the hinge provides a single degree of freedom for the breaking of the shaft. The hinge pivot line is oriented so that the shaft will not break under the acceleration of a properly executed swing, but if the club is jerked transversely or is twisted during the swing, then the shaft will break. This arrangement is well adapted to the prevention of a number of common swing faults.

We have found that although this type of design is broadly satisfactory functionally, it has various structural deficiencies. The effects of wear over a long period of use can produce substantial changes in the characteristics of the club, and can even result in total failure.

The sensitivity of these known clubs can be adjusted by changing the tension of the spring loading the detent element. For this purpose, the end of the spring away from the detent element rests against an adjustment screw. In Reineking, the screw is located at the end of the handle half-shaft and is therefore accessible, but the spring has to extend along the whole length of the handle half-shaft from the screw to the detect element. The adjustment sensitivity is therefore small even with the handle half-shaft being considerably shorter than the head half-shaft, and would be negligible for the preferred position of the hinge. In Koch and Koch, the adjustment screw can be adjusted for initial setting but cannot be accessed thereafter.

The main objects of the present invention are to provide an improved training golf club with a hinge, and an improved hinge for use in a training golf club.

Accordingly the invention provides, in one aspect, a spring-loaded hinge for a training golf club, characterized by first and second main hinge components located side by side, pivoted together for relative rotation, and having respective shank means for attachment to respective half-shafts of the club, each shank means being oriented perpendicular to the pivot axis, the first main component including spring-loaded means movable parallel to the pivot axis and the second main component having circular track means against which the spring-loaded means bear, and depression means in which the spring-loaded means engage when the two shank means are aligned in parallel.

The hinge also preferably includes means for adjusting the strength of the spring loading.

The invention also provides a golf club using such a hinge.

These and further significant features of the invention will become apparent from the following description of a training golf club and four hinges therefor, all embodying the invention, given by way of example and with reference to the drawings, in which:

FIG. 2 is a perspective view of a first form of the present hinge;

FIG. 3 is a section through the hinge of FIG. 2;

FIG. 4 is an exploded perspective view of the pivot and pressure members of the hinge of FIG. 2;

Figure 1:
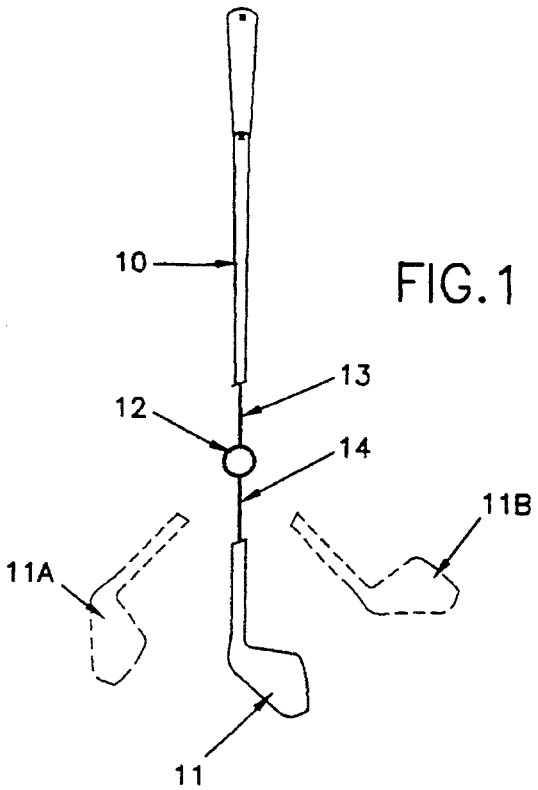
FIG. 1 shows a golf club including the present hinge in exploded form.

Referring to FIG. 1, the golf club comprises three major components; a handle half-shaft 10, a head half-shaft 11, and a hinge 12. The hinge includes shank means such as two pegs 13 and 14 which are fixed to the half-shafts in any convenient manner; for example, the ends of the two half-shafts at the hinge may have axial bores (not shown) to receive these pegs, with the pegs being fixed in the bores by screw threading, adhesive, and/or transverse pins. As depicted in the drawing figures, the pegs or shank means are respectively offset from their associated hinge component and towards the other hinge component such that the two shanks are in alignment along a common axis when in the solid line position of FIG. 1. Alternatively, the pegs 13 and 14 may be of large diameter and bored to receive the ends of the two half-shafts. The hinge 12 includes a spring-loaded detent mechanism, so that the two half-shafts of the club are normally in alignment as shown. However, when the club is swung incorrectly, the spring "breaks" and the lower half-shaft 11 rotates to a position such as 11A or 11B.

FIG. 2 shows one form of the hinge 12, which comprises two arms 20 and 21. The detent mechanism is concealed within the body of the hinge, and is not visible when the hinge is assembled, as shown in this view. The hinge has three visible parts, the two arms 20 and 21 and a pivot member 24. The arms 20 and 21 terminate in the pegs 13 and 14. For simplicity in drawing, the mating parts of the arms 20 and 21 are shown as having square sections, though in practice they are preferably cylindrical or otherwise rounded.

Arm 20 has its upper half cut back, leaving a lower projecting tongue 22, and arm 21 has its lower half cut back, leaving an upper projecting tongue 23. Tongue 23 lies over tongue 22, and the pivot member 24 passes through the two tongues as shown. The two arms 20 and 21 are squared off at the inner ends 25 and 26 of their cut-backs and the tongues 22 and 23 are rounded at their ends, to allow the two arms 20 and 21 to rotate relative to each other about the pivot member 24.

As shown in FIG. 3, the pivot member 24 which joins the two arms 20 and 21 is screwed into the tongue 23 of arm 21 and has a head 30 which engages with a bushing 31 in the tongue 22 of arm 20. The pivot member 24 has an axial bore containing a coil spring 32, and a bolt 33 is screwed into the lower end of this bore, engaging with a bushing 34. The bushings 31 and 34 provide seals around the head 30 and the head of the screw 33; bushing 31 also allows the member 24 to rotate inside the tongue 23.

The tongues 22 and 23 are hollowed out on their mating faces to form a cylindrical void 35, which contains a set of four balls 36 held in place by a free-floating annulus 37 with apertures for the balls. The lower face 38 of the upper tongue 23 has a circular track in which the balls can run.

The balls also engage with the circular annulus 40 of a pressure member 41 which, as shown in FIG. 4, has a cranked arm 42 which fits in a slot 43 formed in the pivot member 24. The top end 44 of the arm 42 is engaged by the spring 32, which pushes the pressure member upwards to compress the balls 36 between it and the lower face of tongue 22. The annulus 40 has grooves 45 in which the balls normally sit. (Rollers can be used instead of the balls 36; if balls are used, spherical depressions can be used instead of the grooves 45.)

For convenience in drawing, the balls 36 and the annuluses 37 and 40 are shown as substantially filling the void 35. In practice, however, the balls and annuluses can be made smaller, leaving a space around the outside of the void. The facing faces of the tongues 22 and 23 can then have circular extensions facing towards each other, with matching grooves holding a bushing ring (not shown) which allows relative rotation of the two arms 20 and 21 but seals the void.

The two arms 20 and 21 can thus rotate about the pivot member 24. For rotation to occur, however, the balls 36 must lift out of the grooves 45. For this, sufficient force must be exerted to push the pressure member 41 downwards against the force of the spring 32. Rotation will therefore occur only if the rotatory force exceeds a threshold value.

The two half-shafts 10 and 11 of the golf club are thus held aligned during a good swing, but break, allowing the head half-shaft 11 to rotate away from the axis of the handle half-shaft 10, if the swing is jerky or otherwise bad. The critical force at which the break occurs can be adjusted by turning the bolt 33 in the pivot member 24 and so adjusting the force of the spring 32.

Obviously, the circular track in the lower face 38 of the upper tongue 23 in which the balls run can be provided with depressions or grooves, like the grooves 45. The grooves in the circular track may be either alternative to or additional to the grooves 45.

Figure 5:
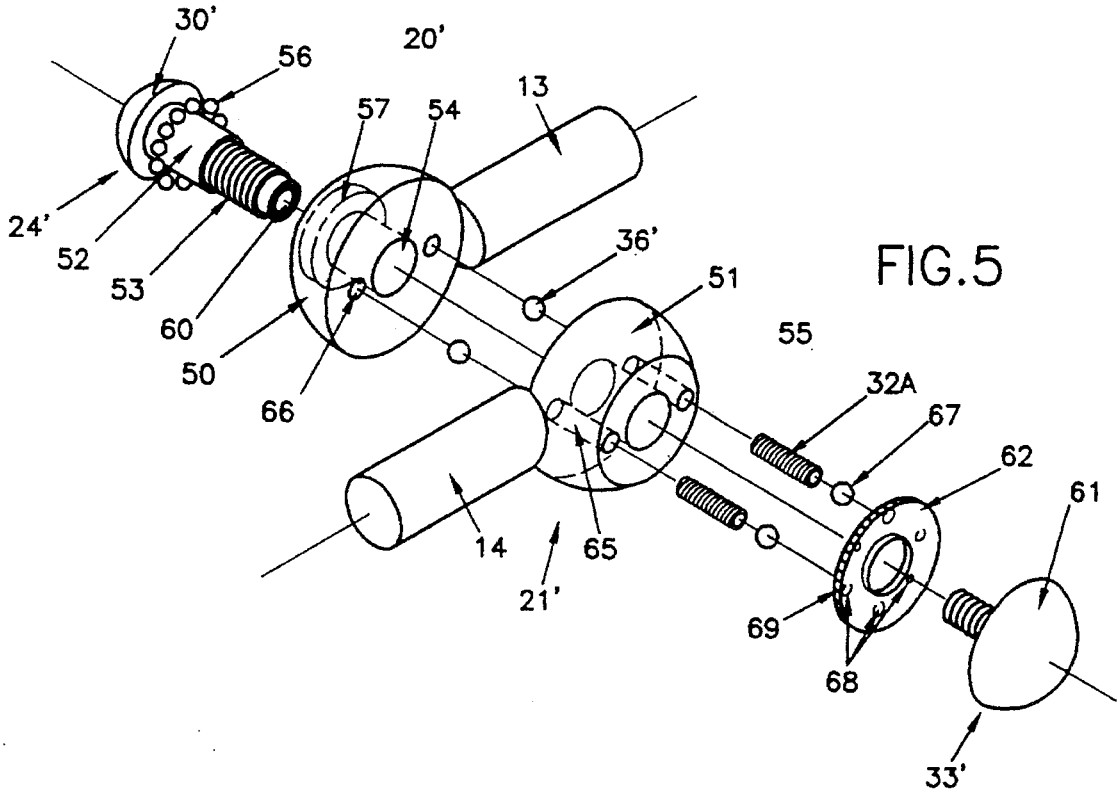
FIG. 5 is an exploded perspective view of a second form of the present hinge.

FIG. 5 shows a second form of hinge, using corresponding references where feasible. The hinge consists of two major parts, a pair of arms 20' and 21', and a pivot member 24'. The arms 20' and 21" consists of substantially hemispherical head portions 50 and 51 with the pegs 13 and 14 projecting from them, as shown.

The pivot member 24' has a shaft comprising a smooth first section 52 and a narrower threaded second section 53. The head 50 has a smooth axial bore 54, and the head 51 has a threaded axial bore 55. The pivot member passes through the head 50, with its smooth section engaging with the smooth bore 54, and into the head 51, with its threaded section being screwed tightly into the threaded bore 55. The head 50 has a circular groove 57 around the entrance to the bore 54, and a set of balls 56 are trapped in that groove by the head 30' of the pivot member 24', forming a ball bearing and allowing the pivot member 24' and the head 51 to rotate, as a single unit, relative to the head 50.

The pivot member 24' has a threaded bore 60 at its end, and a bolt 33' with a round head 61 is screwed tightly into this bore, trapping a ring or annulus 62 between the head 61 and the head 51. The depth of the bore 60 is slightly less than the length of the bolt 33', so that the annulus 62 is held loosely enough to allow it to be rotated.

The head 51 has a set of narrow bores 65 offset from but parallel to the main bore 55. Each of these bores contains a spring 32A which is compressed between the annulus 62 and one of a set of balls 36' also contained in the bores 65. The inner face of the head 50 has a set of depressions 66 matching the bores 65 and with which the balls 36' engage.

The two arms 20' and 21' can thus rotate about the pivot member 24'. For rotation to occur, however, the balls 36' must lift out of the depressions 66 to run over the smooth face of the head 50. For this, sufficient force must be exerted to push the balls into the bores 65 against the force of the springs 32A. Rotation will therefore occur only if the rotatory force exceeds some threshold value.

A second set of balls 67 are interposed between the springs 32A and the annulus 62, and this annulus has, on the face away from the head 61, a plurality of depressions 68, arranged in sets. The depressions of each set are all of the same size, and are spaced around the annulus so that for a suitable position of the annulus, they are all opposite the bores 65. The depressions of the different sets are of different sizes.

The balls 67 are forced into engagement with one of the sets of depressions 68 by the springs 32A, holding the annulus 62 in place against rotation. The annulus has a rim 69 which is knurled or otherwise formed so that it can be rotated (eg by engagement with a suitable tool, not shown) against the holding force of the springs 32A to bring the balls 67 into engagement with any desired one of the sets of depressions 68. Since the depressions of the different sets are of different depths, the balls 67 will take up slightly different longitudinal positions within their bores 65 in dependence on the set of depressions engaged. This will change the compression of the springs 32A and so allow adjustment of the critical force at which the break of the hinge 12' occurs.

The adjustment annulus 62 could of course be provided with ramps against which the balls 67 bear instead of the sets of depressions 68, allowing a continuous adjustment of the "break" force. Its edge is preferably knurled or otherwise roughened to make it easier to grip.

Obviously there can be any convenient number of balls 36 or 36' from two upwards. A single ball could be used, but that would result in unbalanced forces, which is undesirable. If desired, one or two additional sets of grooves 45 or depressions 66 can be provided, spaced slightly away from the main set, to hold the hinge in a broken position once the club has broken from the aligned position. It is convenient to use balls which can rotate, but non-spherical elements which merely slide could in principle be used.

Figure 6:
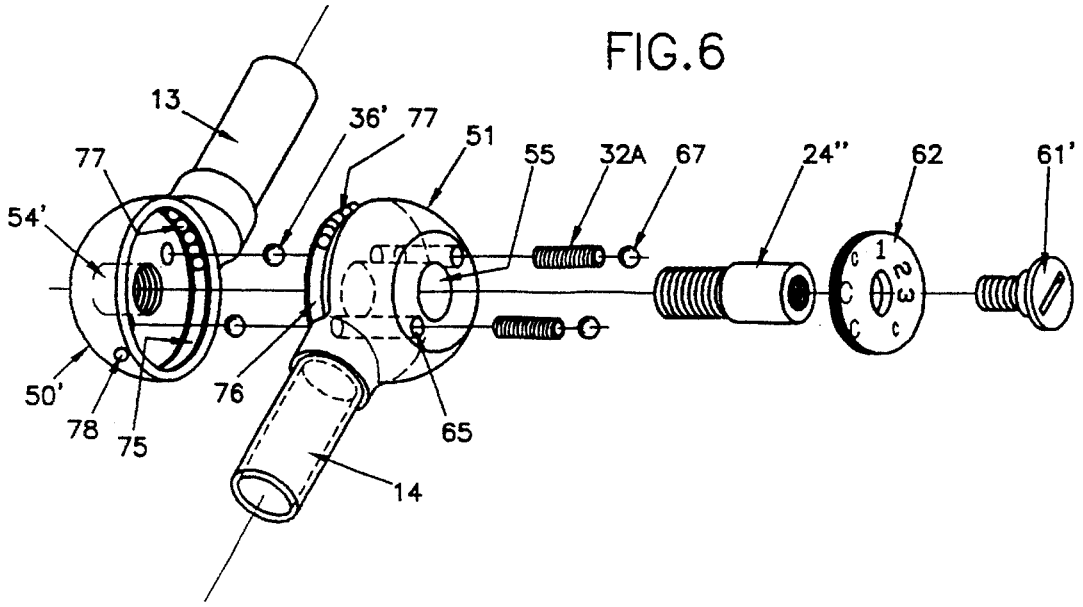
FIG. 6 is an exploded perspective view of a third form of the present hinge.

FIG. 6 shows a third form of hinge, again using corresponding references where feasible. This hinge is a variant of the FIG. 5 hinge, the major difference being in the manner in which the two main hinge parts or bodies 50' and 51' of the hinge are pivoted together. The circular face of part 50' facing part 51' is provided with a rim projecting towards part 51', forming an inward facing groove 75. The part 51' has its rim cut back to form a corresponding groove 76. These two grooves 75 and 76 together form a ball race containing balls 77, which are inserted into the race through a filler hole 78 (which can be sealed after the race is filled). The two parts 50' and 51' therefore pivot about each other by means of this ball race 75–76.

The shaft 24" is still present, to assist in retaining the two hinge bodies together, and to retain the adjustment disc 62, although this shaft is no longer essential for pivoting. This shaft passes smoothly through the body 51' and is threaded at its left-hand end, and the bore 54' in body 50' is threaded to engage with this shaft.

Figure 7:
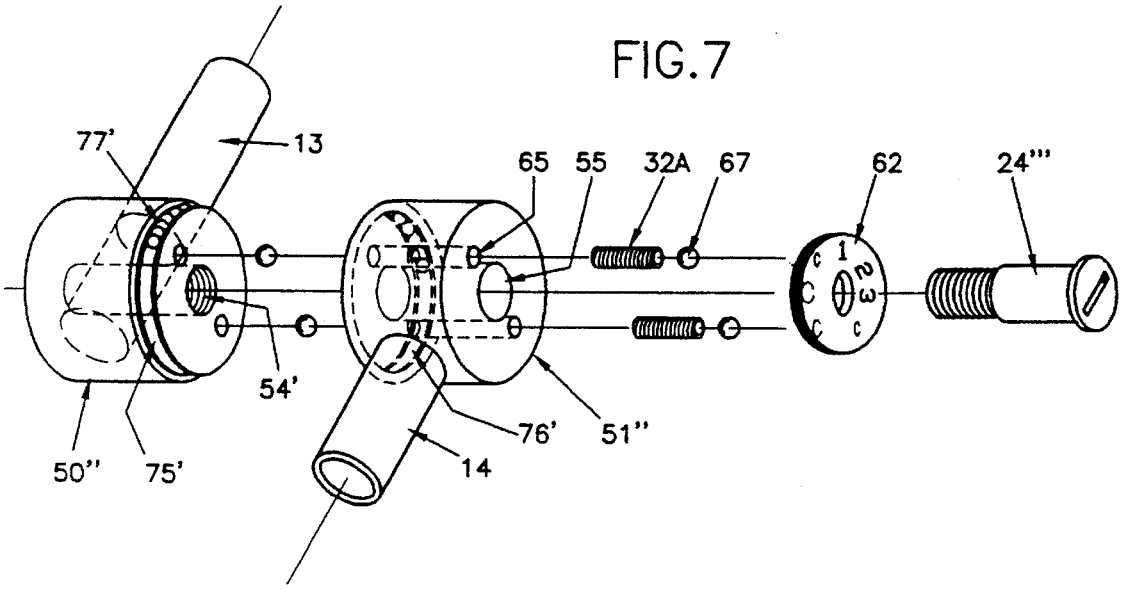
FIG. 7 is an exploded perspective view of a fourth form of the present hinge.

FIG. 7 shows a fourth form of hinge, again using corresponding references where feasible. This hinge is a variant of the FIG. 6 hinge, the major difference being in the external shape of the two main hinge parts or bodies 50' and 51". As shown, the two hinge bodies are generally cylindrical instead of hemispherical, and the two shaft attachment stubs 13 and 14 are offset from each other. In this hinge, body 51" has the projecting rim forming a groove 76' and body 50" has its rim cut back forming a groove 75", so reversing the orientation of the ball race of FIG. 6. Also, the shaft 24'" now retains the adjustment ring 62, so that the separate retaining screw 61 of FIG. 5 is no longer required.

In general terms, a leading feature of these arrangements in the provision of spring-loaded elements acting substantially parallel to the pivot axis of the hinge. More specifically, in the preferred embodiments, the hinge consists of two major portions, one for each half-shaft, located side by side with the pivot axis (which is transverse to the axes of the half-shafts) passing through them, and the spring-loaded elements are balls arranged around the pivot axis. In one preferred embodiment, the balls pass between a circular path on the face of one major portion and an annulus resiliently coupled to the other major portion, with either the circular path or the annulus having depressions to provide the detent action. In another preferred embodiment, the balls pass along a circular path on the face of one major portion and are located in spring-containing bores in the other major portion, with the circular path having depressions to provide the detent action.

I claim:

1. A spring-loaded hinge mechanism interposed in a training golf club between a first shaft formed with a hand grip and a second shaft formed with a club head, comprising a first main hinge component and a second main hinge component pivotally secured together for relative pivotal movement about a pivot axis, said first and second main hinge components respectively including first shank means and second shank means, each for securing the respective first and second hinge component to a respective one of said first and second shafts; each first and second shank means extending parallel to said pivot axis, said first main hinge component including spring-loaded means, movable parallel to the pivot axis, for exerting a spring force between said first and second hinge components; depression means, mounted adjacent said spring-loaded means, for engagement with said spring-loaded means when said first and second shank means are parallel with each other; and said second hinge component including circular track means for guiding relative rotation of said first and second hinge components about the pivot axis under the action of said spring force.

2. A hinge according to claim 1, wherein said first and second shank means are respectively off-set towards the second and first main hinge component such that the first and second shank means are alignable along a common axis.

3. A hinge according to claim 1, wherein said spring-loaded means includes a plurality of spring-loaded elements eguispaced around the pivot axis.

4. A hinge according to claim 3, wherein each spring-loaded element includes a spring bearing upon a ball engageable with the depression means.

5. A hinge according to claim 4, wherein each spring-loaded element is located in a respective bore in the first main component.

6. A hinge according to claim 5, further comprising an adjustment ring against which an end of each spring-loaded element, remote from the circular track means, bears, said adjustment ring being rotatable to vary the axial position of the remote end.

7. A hinge according to claim 6, wherein said adjustment ring is mounted on a screw having a screw axis coincident with the pivot axis.

8. A hinge according to claim 6, wherein said adjustment ring includes a plurality of depressions of different depth into which said remote ends can engage for variation of said axial position.

9. A hinge according to claim 6, wherein said adjustment ring includes, for each spring-loaded element, a respective ramp on its face.

10. A hinge according to claim 1, wherein said spring-loaded means includes a ring movable under spring bias along the pivot axis and being co-rotatable with the first main hinge component, and said spring-loaded means further includes ball means held between the ring and the circular track means.

11. A hinge according to claim 10, wherein the ring includes said depression means in which the ball means are normally located.

12. A hinge according to claim 11, wherein said circular track means also includes depression means in which the ball means are normally located.

13. A hinge according to claim 10, further including a pivot shaft forming part of the first main hinge component, said pivot shaft having longitudinal slot means therein and a central bore containing a spring said ring having inward projection means, passing through the slot means in the pivot shaft, against which said inward projection means the spring bears.

14. A hinge according to claim 13, wherein the spring in the pivot shaft beans, at an end opposite the inward projection means, against an adjustment screw mounted in the pivot shaft.

15. A hinge according to claim 1, wherein one of said first and second main hinge components includes a rim extended to form an inward-facing groove and the other of said first and second main hinge components has a rim which is cut back to form an outward facing groove, said inward and outward facing grooves together forming the circular track means including a ball race containing balls which hold the first and second main hinge components together and allow them to rotate relative to each other.

16. A training golf club comprising a first shaft formed with a hand grip and a second shaft formed with a golf club, and a spring-loaded hinge mechanism connecting said first and second shafts together, said spring-loaded hinge mechanism comprising a first main hinge component and a second main hinge component pivotally secured together for relative pivotal movement about a pivot axis, said first and second main hinge components respectively including first shank means and second shank means, each for securing the respective first and second hinge component to a respective one of said first and second shafts; each first and second shank means extending parallel to said pivot axis, said first main hinge component including spring-loaded means, movable parallel to the pivot axis, for exerting a spring force between said first and second hinge components; depression means, mounted adjacent said spring-loaded means, for engagement with said spring-loaded means when said first and second shank means are parallel with each other; and said second component including circular track means for guiding relative rotation of said first and second hinge components about the pivot axis under the action of said spring force.

* * * * *